US006675612B2

(12) United States Patent
Nanasi

(10) Patent No.: US 6,675,612 B2
(45) Date of Patent: Jan. 13, 2004

(54) LOCKING MECHANISM FOR BANGLE AND BANGLE HAVING SAME

(75) Inventor: John Nanasi, Englewood, NJ (US)

(73) Assignee: Nanasi Enterprises, Inc., Hackensack, NJ (US)

( * ) Notice: Subject to any disclaimer, the term of this patent is extended or adjusted under 35 U.S.C. 154(b) by 0 days.

(21) Appl. No.: 10/086,966

(22) Filed: Mar. 4, 2002

(65) Prior Publication Data

US 2003/0164003 A1 Sep. 4, 2003

(51) Int. Cl.[7] ..... A44C 5/00

(52) U.S. Cl. ..... 63/3.2; 63/7; 63/8; 63/3; 24/20 EE; 24/615

(58) Field of Search ..... 63/3, 3.2, 8, 7; 24/265 WS, 614, 615, 20 R, 20 EE

(56) References Cited

U.S. PATENT DOCUMENTS 273,241 A * 2/1883 Moore ..... 24/662
2,306,317 A * 12/1942 Morrow ..... 63/7
2,522,852 A * 9/1950 Apps ..... 63/7
4,605,312 A * 8/1986 Sellier ..... 368/282
4,763,490 A * 8/1988 Bruner ..... 63/15.7
4,879,883 A * 11/1989 Bruner ..... 63/15.7
6,125,657 A * 10/2000 Esposito ..... 63/12
6,131,245 A * 10/2000 Chi ..... 24/20 R

* cited by examiner

*Primary Examiner*—Andrea Chop
(74) *Attorney, Agent, or Firm*—Levisohn, Berger & Langsam, LLP

(57) ABSTRACT

A locking mechanism for a bangle having a main body shaped in an openable loop. The inner side of the bangle is worn against the skin of the wearer. The bangle is a discontinuous loop having a first end and a second end engageable with the first end to thereby close the loop of the main body. The locking mechanism includes a bar attached transversely across the first end of the main body on the inner side; the bar has a front edge and a rear edge. A tongue is provided attached at a fixed end to the second end of the main body projecting from the second end, the tongue having a raised detent portion at a free end opposite the fixed end. Alternatively, the bangle is circular in cross-section and the locking mechanism is disposed in the interior of the bangle. In either event, when the locking mechanism is closed, the tongue passes under the front edge of the bar and the raised detent portion catches on the rear end of the bar, thereby locking the bangle closed and giving it the appearance of being a continuous unbroken loop of material.

7 Claims, 5 Drawing Sheets

LOCKING MECHANISM FOR BANGLE AND BANGLE HAVING SAME

BACKGROUND OF THE INVENTION

1. Field of the Invention

The invention relates to jewelry and more particularly to locking mechanisms for jewelry and especially bangles.

2. Description of the Related Art

Jewelry is a common fashion accessory for many people. One form of jewelry that has proven popular over the millennia is the bracelet, a typically round/toroid structure that fits around the wrist of the wearer. Some people wear similar articles on their ankles, i.e., anklets. Some bracelets are made from chain or mesh material while others are solid. Of the solid bracelets, some are continuous loops through which the wearer must squeeze her hand, while others are discontinuous loops which do not extend all the way around a person's wrist. Of the continuous variety, one common type of bracelet is the bangle, a usually inexpensive, flexible, typically thin bracelet. Other forms of jewelry (such as necklaces) have opening and closing means, i.e., a locking mechanism, which allow the wearer to open the loop of the article, put it around the wearer, and then close the loop of the article without undue difficulty or discomfort. Among the many types of jewelry clasps are the spring-loaded catch (a loop that is spring-biased closed which can be opened, intertwined with a fixed loop on the other end of the article, and then allowed to close) and the "figure-8" clasp (a simple hinged lever with an open loop which tightly fits around a corresponding post on the other end of the article).

Part of the charm of a bangle, however, is that it is generally supposed to be a single, continuous loop with no top, bottom, side, or other distinguishing feature. The provision of a standard jewelry clasp on a bangle would ruin the visual effect of a single continuous bangle. Also, bangles are typically extremely inexpensive articles of jewelry. Adding a fancy clasp to the bangle would add to the expense of the bangle in both material and cost to manufacture. Further, the bangle is typically made from a flexible material. By providing a discontinuous band of metal or plastic, the ends thereof must be properly aligned to close the loop.

SUMMARY OF THE INVENTION

It is an object of the invention to provide a locking mechanism for a bangle that can be opened and closed.

It is another object of the invention to provide a locking mechanism for a bangle which is very secure and that a wearer can feel comfortable wearing.

It is another object of the invention to provide a locking mechanism for a bangle which is inexpensive, easy to manufacture, and audibly clicks closed so the wearer can be certain that it is closed.

It is another object of the invention to provide a locking mechanism for a bangle which insures the proper alignment of the two ends of the bangle.

It is another object of the invention to provide a locking mechanism for a bangle that is invisible when the bangle is being worn and gives the illusion of a seamless, continuous bangle.

It is another object of the invention to provide a locking mechanism for a bangle which conforms to the shape of the bangle without requiring significant modifications thereto.

The above and other objects are fulfilled by the invention, which is a locking mechanism for a bangle having a main body shaped in an openable loop. The inner side of the bangle is worn against the skin of the wearer. The bangle is a discontinuous loop having a first end and a second end engageable with the first end to thereby close the loop of the main body. The locking mechanism includes a bar attached transversely across the first end of the main body on the inner side; the bar has a front edge and a rear edge. A tongue is provided attached at a fixed end to the second end of the main body projecting from the second end, the tongue having a raised detent portion at a free end opposite the fixed end. When the locking mechanism is closed, the tongue passes under the front edge of the bar and the raised detent portion catches on the rear end of the bar, providing an audible click and locking the bangle closed. The provision of an audible click is significant, in that it lets the wearer know in no uncertain terms that the locking mechanism is securely closed. Preferably, the raised detent portion includes an inclined proximal portion which rises away from the inner surface of the bangle, and a declined distal portion at an extreme end of the fixed end. The inclined portion catches on the rear edge of the bar when the locking mechanism is locked. In one embodiment, a hole is formed in the bar, and the rear edge that the detent portion catches on is one of the edges of the hole. In another embodiment, the inclined portion and declined portion form a peak therebetween.

The invention also includes a bangle having the above-described locking mechanism.

DETAILED DESCRIPTION OF THE PREFERRED EMBODIMENTS

Description of the invention will now be given with reference to exemplary drawing FIGS. 1–9 appended hereto. It should be understood that these drawings are merely representative and are in no way meant to limit the scope of the invention.

Figure 3:
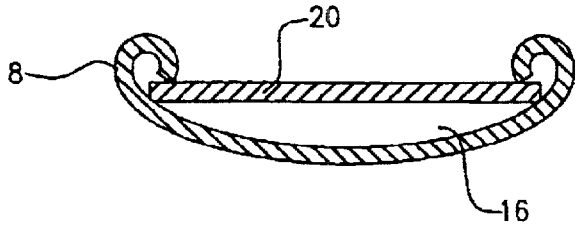
FIG. 3 is a sectional view of the bangle and locking bar taken along line 3—3 shown in FIG. 2.
Figure 4:
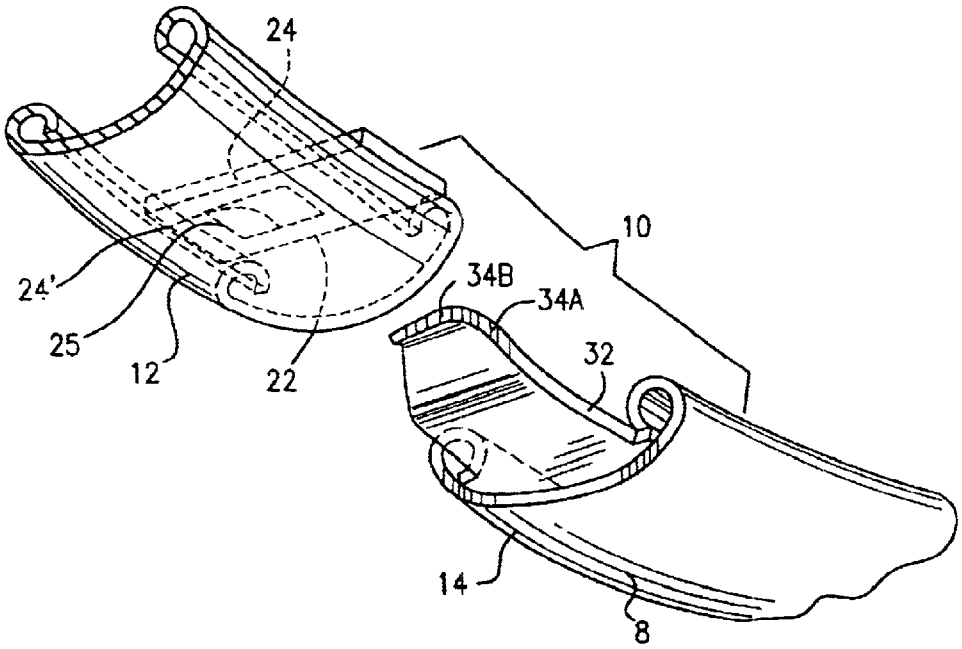
FIG. 4 is an enlarged perspective view of the bangle locking mechanism of the invention.
Figure 5:
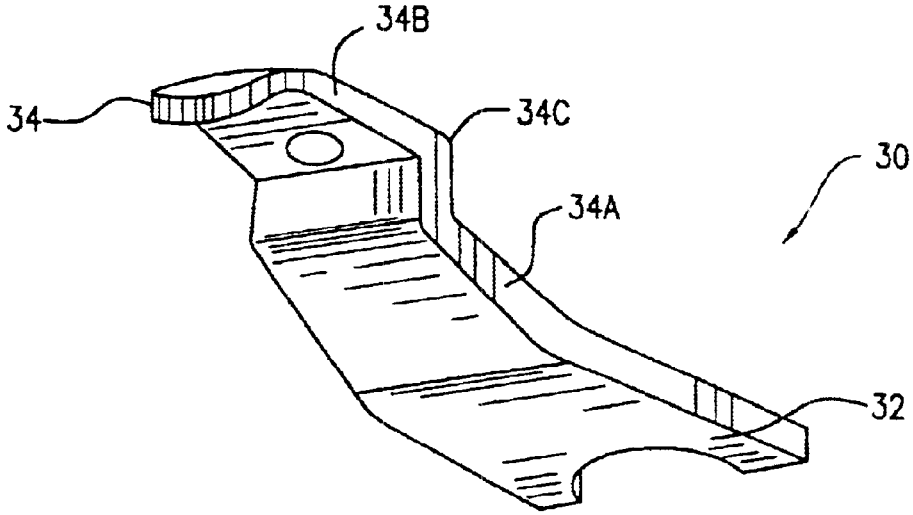
FIG. 5 is an enlarged perspective view of the tongue of the bangle locking mechanism of the invention.
Figure 6:
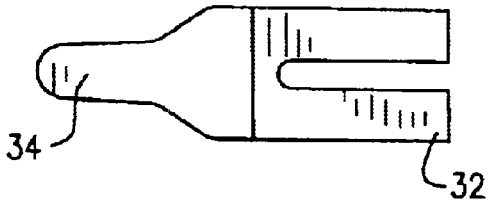
FIG. 6 is a top elevational view of the tongue of the bangle locking mechanism of the invention.

The inventive bangle 5 includes a main body 8 and a locking mechanism 10. As shown best in FIG. 4, main body 8 is a discontinuous loop having a first end 12 and a second end 14. The interior of the main body is concave and forms a circumferential channel 16 (FIG. 3). A locking bar 20 is attached to first end 12 in channel 16. Bar 20 is fixed to first end 12 transversely across channel 16 as shown in FIGS. 3 and 4. Bar 20 has a front edge 22 and a rear edge 24.

Disposed in the second end 14 is tongue 30 which has a fixed end 32 and a free end 34. Fixed end 32 is fixedly attached to second end 14 in channel 16, and free end 34 projects circumferentially out from second end 16. Preferably, the fixed end is wider than the free end, and the width of the fixed end is substantially the same width as the circumferential channel 16. More preferably, part of the fixed end extends beyond the second end 14. A raised detent portion is formed in free end 34. In the preferred embodiment, the raised detent portion is formed as a peak between inclined surface 34A and declined surface 34B.

In operation, when locking mechanism 10 is closed, tongue 30 passes under front edge 22 of bar 20 and the raised detent portion catches on rear edge 24 of bar 20, thereby locking the bangle closed. As mentioned, fixed end 32 of tongue 30 fits within the circumferential channel on the second end of the bangle and extends beyond and protrudes from the second end of the bangle in an extended portion 32A (see FIG. 2). Since extended portion 32A is the same or substantially the same width as the rest of the fixed end, extended portion 32A fits into circumferential channel 16 on first end 12 of the bangle when the locking mechanism is closed to thereby align the first and second ends when the locking mechanism is closed.

Figure 1:
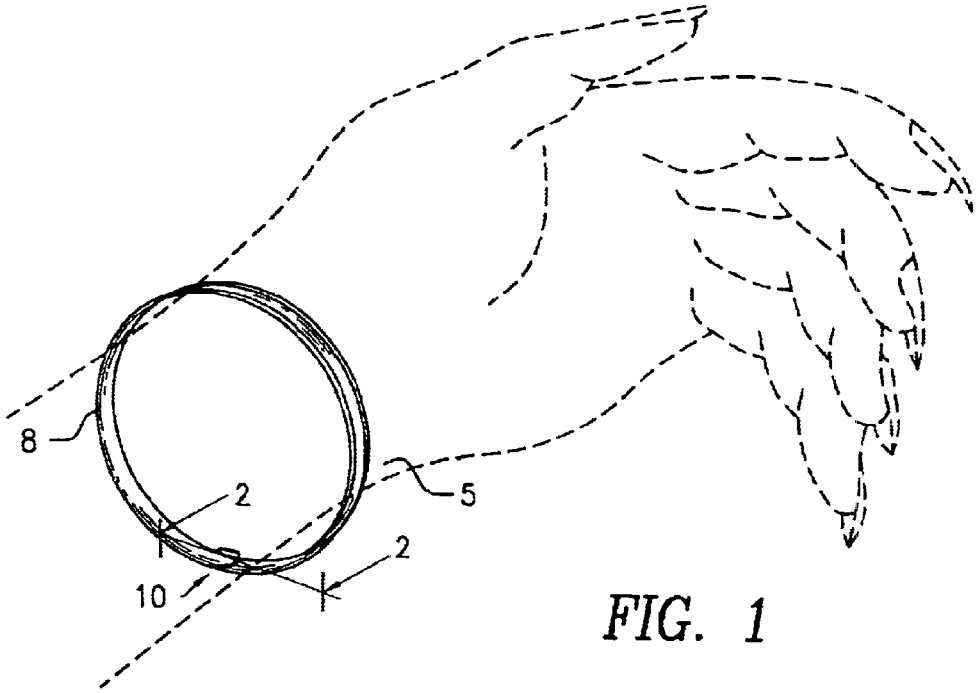
FIG. 1 is a perspective view of a bangle in accordance with the invention being worn on a wrist (in phantom lines).
Figure 2:
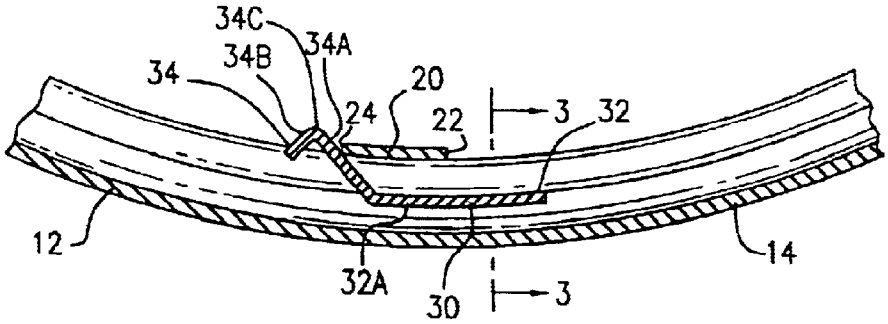
FIG. 2 is a sectional view of one embodiment of a bangle and locking mechanism according to the invention taken along line 2—2 shown in FIG. 1.

Preferably, the detent portion of tongue 30 is made from a flexible, resilient material. When the peak 34C passes rear edge 24 of bar 20, peak 34C audibly clicks the locking mechanism closed. This audible signal lets the wearer know that the locking mechanism is secured on her wrist or ankle and is very reassuring to the wearer. Also, the provision of the locking mechanism on the underside of the bangle is advantageous in that when the bangle is click-locked onto the wearer's arm/leg, the locking mechanism is hidden from view by main body 8. Moreover, since the extended portion 32A helps to align and maintain alignment of first and second ends 12 and 14, the seam between the two ends of the bangle becomes very difficult to discern, and the bangle appears to be a single continuous loop of material. Free end 34 may be shaped like an inverted V as shown in FIG. 2, or, in another embodiment shown in FIG. 9, free end 34' may be curved in the shape of a sickle or a question mark. In either case, the user would reach under the bangle with a finger and push on free end 34, 34' to disengage locking mechanism 10.

In an alternative embodiment, bar 20 is provided with a hole 24' having interior edges 25 (FIG. 4). The distal free end 34 of tongue 30 may catch on one of the edges 25 of hole 24' instead of the absolute rear edge 24 of the bar. Hole 24' is shown as a quadrilateral in FIG. 4, however it may be formed in any convenient geometry in bar 20.

The bangle main body may be made from any material, such as plastic, wood, metal, rubber, etc. The tongue is preferably made from a similar material which is flexible, resilient, and capable of withstanding numerous deformations without failure. Such materials are known to those of skill in the art.

Figure 7A:
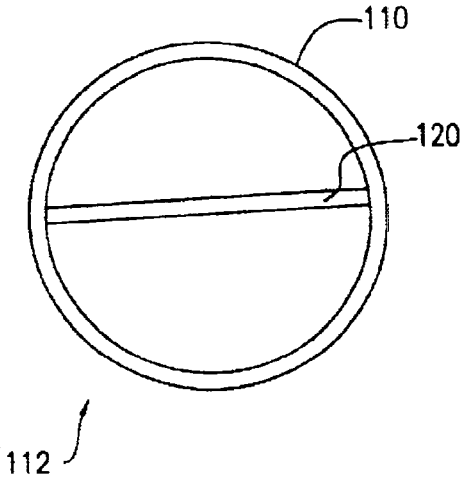
FIGS. 7A and B are end view schematics of the first and second ends of an alternate embodiment of the invention having an internal locking mechanism.
Figure 7B:
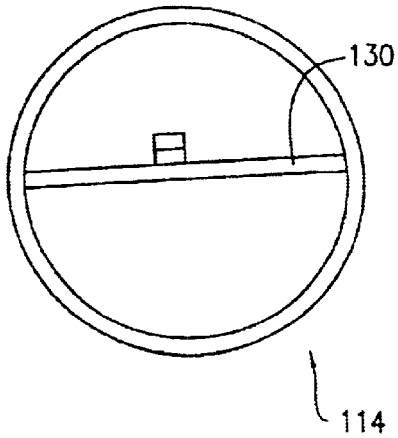
Figure 8:
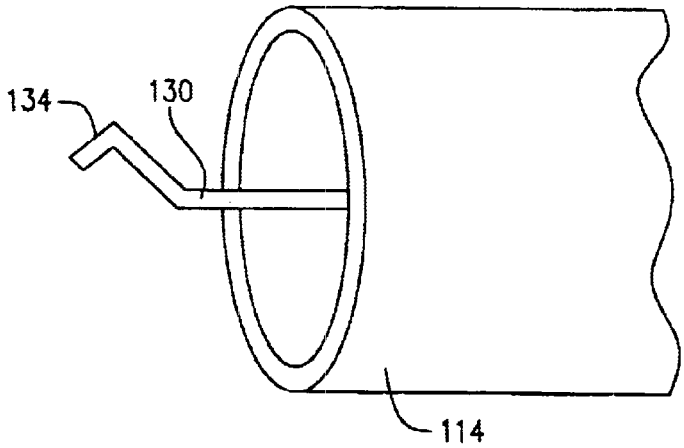
FIG. 8 is a side perspective view of the tongue end of the bangle of FIG. 7.
Figure 9:
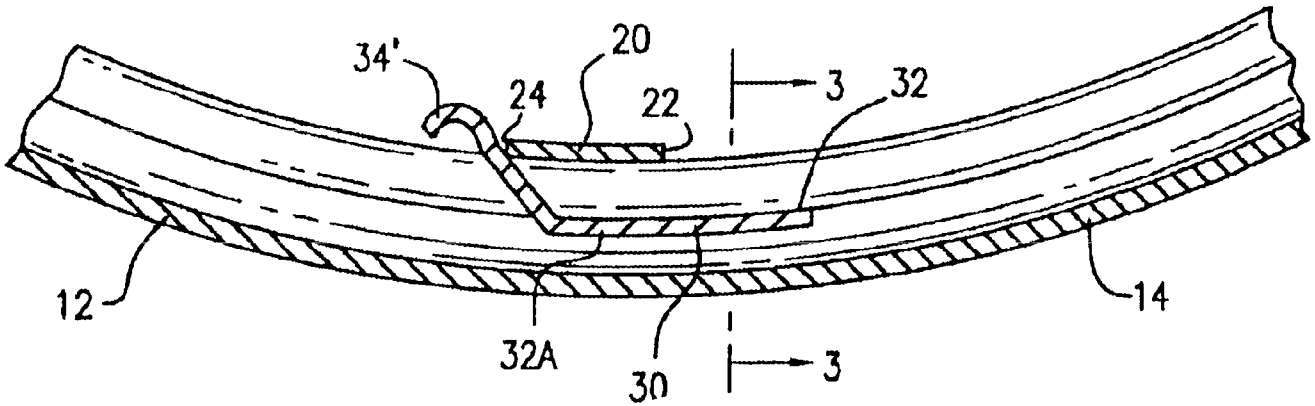
FIG. 9 is a sectional view of another embodiment of the invention similar to that of FIG. 2.

Having described this invention with regard to specific embodiments, it is to be understood that the description is not meant as a limitation since further modifications and variations may be apparent or may suggest themselves to those skilled in the art. For example, main body 8 is shown in a circular configuration, however it may also be square, triangular, polygonal, or some irregularly-shaped closable loop of material. Also, the locking mechanism is shown as being on the under side or inner side of a bangle with a concave cross-section. However, it is also contemplated that the bangle be circular in cross-section and has an internal locking mechanism as shown in FIGS. 7–8. Bangle 110 is circular in cross-section and has a first end 112 and a second end 114. Bar 120 is disposed in first end 112, and tongue 130 is disposed in second end 114. Free end 134 of tongue 130 projects from second end 114 as with the prior embodiment.

Additionally, the bar in the locking mechanism is shown as being relatively horizontal in the figures. However, it is contemplated that the bar may be disposed at any angle and need not extend fully across the width of the bangle main body (be it concave or circular in cross-section).

The invention is not limited to the above description but rather is defined by the claims appearing hereinbelow. Modifications to the above description that include that which is known in the art are well within the scope of the contemplated invention.

What is claimed is:

1. A lockable bangle, comprising:

a main body shaped in an openable loop, said main body having an inner side to be worn against the skin of the wearer and an outer side opposite said inner side, said main body also having a first end and a second end engageable with said first end to thereby close said loop of said main body; and a locking mechanism comprising:

a bar attached transversely across said first end of said main body on said inner side, said bar having a front edge and a rear edge; and a tongue attached at a fixed end to said second end of said main body projecting from said second end, said tongue having a raised detent portion at a free end opposite said fixed end, said raised detent portion being non-coplanar with either said bar or said fixed end, said free end being adapted to be passed by and to engage said bar between said bar and said inner side main body, wherein when said free end of said tongue is passed by said bar, said raised detent portion catches on said bar, thereby closing said locking mechanism and the bangle.

2. A lockable bangle according to claim 1, said raised detent portion comprising:

an inclined proximal portion which rises away from said inner side; and a declined distal portion at an extreme end of said fixed end, wherein said inclined proximal portion catches on said rear end of said bar when said locking mechanism is closed.

3. A lockable bangle according to claim 2, said detent portion being flexible, said inclined and declined portions forming a peak therebetween, wherein when said peak passes said rear edge of said bar, said peak audibly clicks said locking mechanism closed.

4. A lockable bangle according to claim 1, further comprising a circumferential channel formed in said inner side of said main body, wherein said fixed end of said tongue fits within said circumferential channel on said second end, and wherein said fixed end extends beyond and protrudes from said second end in an extended portion of said fixed end, and wherein said extended portion fits into said circumferential channel on said first end to thereby align said first and second ends when said looking mechanism is closed.

5. A lockable bangle according to claim 4, wherein said bar is attached to said first end across said circumferential channel.

6. A lockable bangle according to claim 1, a hole is formed in said bar, said hole having edges, and said rear edge of said bar is one of said edges of said hole.

7. A lockable bangle according to claim 1, said raised detent portion comprising an inclined proximal portion which rises away from the inner side of the main body, wherein said inclined proximal portion catches on said rear edge of said bar when said locking mechanism is closed.

* * * * *